United States Patent [19]

Simila

[11] Patent Number: 4,911,074

[45] Date of Patent: Mar. 27, 1990

[54] APPARATUS FOR AUTOMATICALLY CLEANING

[75] Inventor: Charles E. Simila, Tucson, Ariz.

[73] Assignee: The United States of America as represented by the Secretary of the Air Force, Washington, D.C.

[21] Appl. No.: 210,473

[22] Filed: Jun. 23, 1988

[51] Int. Cl.[4] ..... B41F 35/00; B41L 41/00

[52] U.S. Cl. ..... 101/425; 101/114

[58] Field of Search ..... 101/423, 424, 425, 114, 101/116, 121, 123, 124, 125; 15/256.51

[56] References Cited

U.S. PATENT DOCUMENTS

| | | | |
|---|---|---|---|
| 3,656,200 | 4/1972 | Riley, Jr. | 15/97 |
| 3,693,547 | 9/1972 | Morgan | 101/425 |
| 3,708,818 | 1/1973 | Hotz | 15/97 |
| 3,754,991 | 8/1973 | Amos et al. | 134/4 |
| 3,900,003 | 8/1975 | Sato et al. | 101/425 |
| 4,135,448 | 1/1979 | Moestue | 101/425 |
| 4,232,604 | 11/1980 | Waizmann | 101/425 |
| 4,344,361 | 9/1982 | MacPhee et al. | 101/425 |
| 4,354,292 | 10/1982 | Telestad et al. | 15/77 |
| 4,389,936 | 6/1983 | Jaffa et al. | 101/123 |
| 4,586,433 | 5/1986 | Jaffa et al. | 101/123 |

FOREIGN PATENT DOCUMENTS

| | | | |
|---|---|---|---|
| 2339906 | 2/1975 | Fed. Rep. of Germany | 101/425 |
| 3100656 | 7/1982 | Fed. Rep. of Germany | 101/425 |
| 1522069 | 8/1978 | United Kingdom | 101/425 |

OTHER PUBLICATIONS

Xerox Disc. Jour., Bernhard, "Air Pressure Seal for Cleaner in Copiers", vol. 9, No. 2, Mar./Apr. 1984, pp. 161–162.

*Primary Examiner*—Edgar S. Burr
*Assistant Examiner*—Joseph R. Keating
*Attorney, Agent, or Firm*—Robert L. Nathans; Donald J. Singer

[57] ABSTRACT

The cleaner utilizes a screen cleaning head carriage having a freely rotatable wiper roller, solvent ejector for directing solvent at the web before it passes over the wiper roller during motion of the head carriage in a first direction, and a drying gas ejector for directing drying gas at the screen during motion of the head carriage in a second direction opposite the first direction, together with web feed control means for advancing the web about the wiper roller in advancement increments and retracting the web about the wiper roller in lesser retraction increments interspersed with the advancement increments, to produce a two steps forward and one step back" forward intemittent web motion.

20 Claims, 3 Drawing Sheets

APPARATUS FOR AUTOMATICALLY CLEANING

STATEMENT OF GOVERNMENT INTEREST

The invention described herein may be manufactured and used by or for the Government for governmental purposes without the payment of any royalty thereon.

BACKGROUND OF THE INVENTION

The present invention relates to the field of surface cleaning devices and more particularly devices for automating the cleaning of printing screens.

It is deemed desirable to automate the in-process screen cleaning procedure associated with fabrication of thick-film hybrid microcircuits, including ceramic circuit cards. These microcircuits are composed of thick-film paste deposited by a screen printer using a stencil-like mask, or screen, which defines shapes of circuit components to be printed. Cleaning of the under side of the screen is required perodically during the printing process to assure print quality, and is accomplished manually by an operator who holds a polyfoam wiper in one hand, squirts xylene on it, and reaches under the screen to wipe the print area of the screen. A nitrogen gun is then used to dry excess xylene from the screen.

This manual process has the following disadvantages. The operator is exposed to solvent vapors and hand protection is required to minimize skin contact with the liquid solvent. Occasionally the operator will apply excessive force against the screen during the cleaning step which results in reduced screen life. Also manual screening is slower than desired and transfer of thick-film paste to the edges of the substrates occurs as a consequence of handling parts with the same gloves worn while cleaning the screen.

SUMMARY OF THE INVENTION

It is thus an object of this invention to provide apparatus for automatically cleaning the screen and for consistently controlling the area cleaned, the amount of solvent used, the wiping speed and the pressure exerted against the screen during cleaning.

The preferred embodiment of the invention utilizes a screen cleaning head carriage having a freely rotatable wiper roller, solvent ejector for directing solvent at the web before it passes over the wiper roller during motion of the head carriage in a first direction, and a drying gas ejector for directing drying gas at the screen during motion of the head carriage in a second direction opposite the first direction, together with web feed control means for advancing the web about the wiper roller in advancement increments and retracting the web about the wiper roller in lesser retraction increments interspersed with the advancement increments, to produce a "two steps forward and one step back" forward intemittent web motion.

DESCRIPTION OF THE DRAWINGS

Other objects, features and advantages of the invention will become apparent upon study of the following description, taken in conjunction with the drawings in which.

DETAILED DESCRIPTION OF A PREFERRED EMBODIMENT

Figure 1:
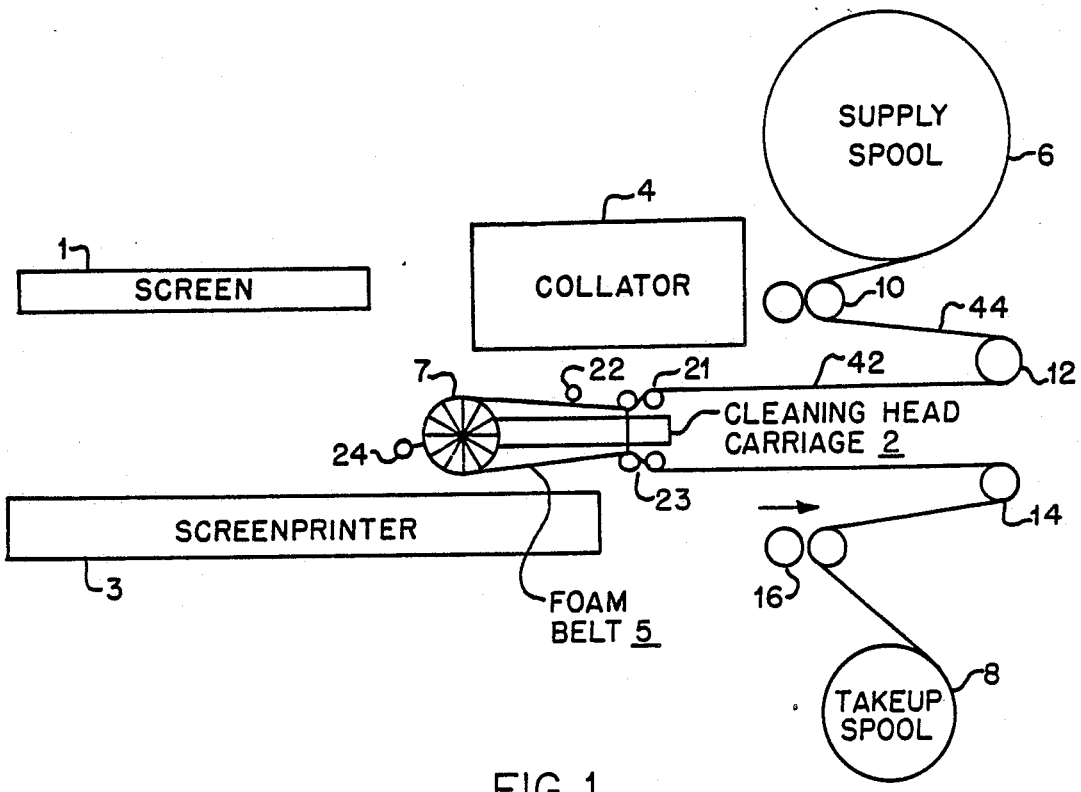
FIGS. 1–3 illustrate the overall operation of the cleaning apparatus.

Referring now to FIG. 1, screen 1 is schematically illustrated along with screen printer 3, cleaning head carriage 2, collator 4, belt supply spool 6, and belt takeup spool 8. The nature of the screen printer and collator form no part of the present invention and thus will not be described in further detail.

Supply spool 6 feeds a porous web or belt 5, preferably of a plastic foam material, widely known as polyfoam. The porous belt passes through the bite of roller pair 10, passes about buffer roller 12, passes through the bite of an upper roller pair 21 mounted upon cleaning head carriage 2 as illustrated. The web material thereafter passes about freely rotatable wiper roller 7, passes through the bite of lower roller pair 23, passes about buffer roller 14 and through the bite of roller pair 16 and is taken up by takeup spool 8. The aforesaid roller structure enables the poly-foam belt to be fed to the cleaning head carriage in increments, to be described in greater detail below, so that fresh foam will be available during the application of liquid solvent to the screen during forward motion of head carriage 2, and also during the drying phase, when the direction of motion of the head carriage is reversed.

Figure 2:
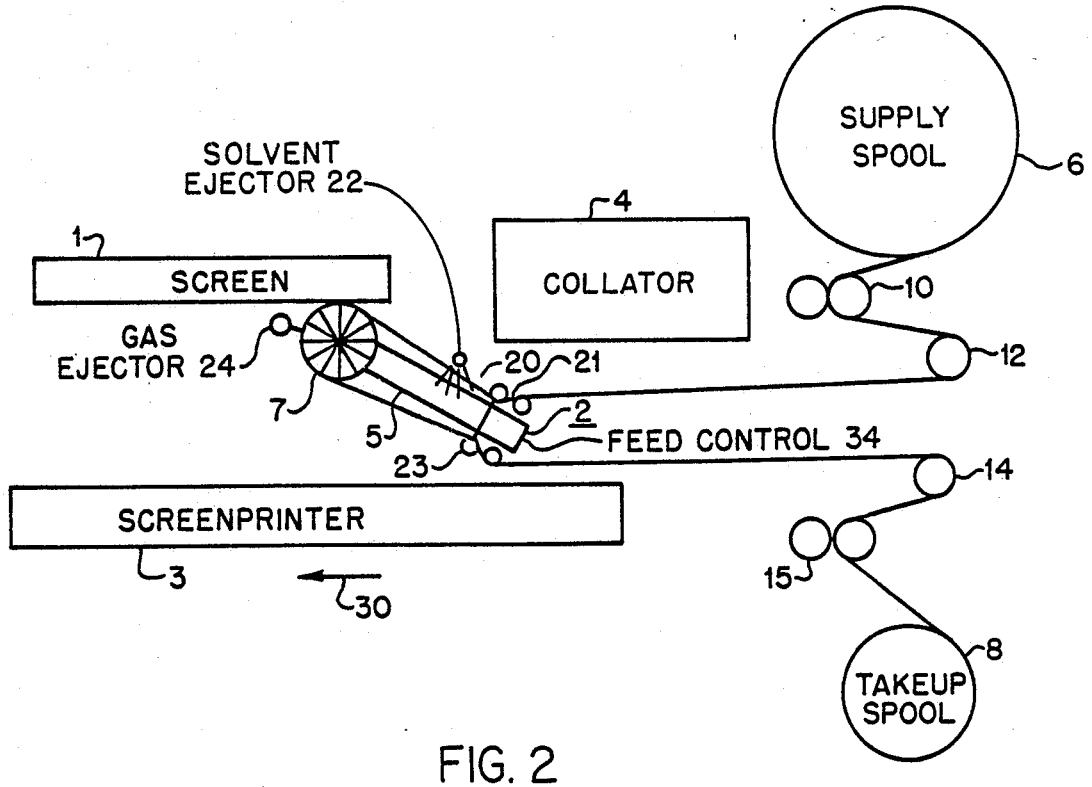

Referring now to FIG. 2, solvent ejector 22 is schematically illustrated, positioned adjacent the porous web as is gas ejector 24. Roller pair 21 also functions as a first Web guide member to guide the Web toward Wiper roller 7. In like manner, roller pair 23 is a second web guide means which enables the web, as it is stepped about wiper roller 7, to be fed to buffer roller 14 in an orderly manner.

Figure 3:
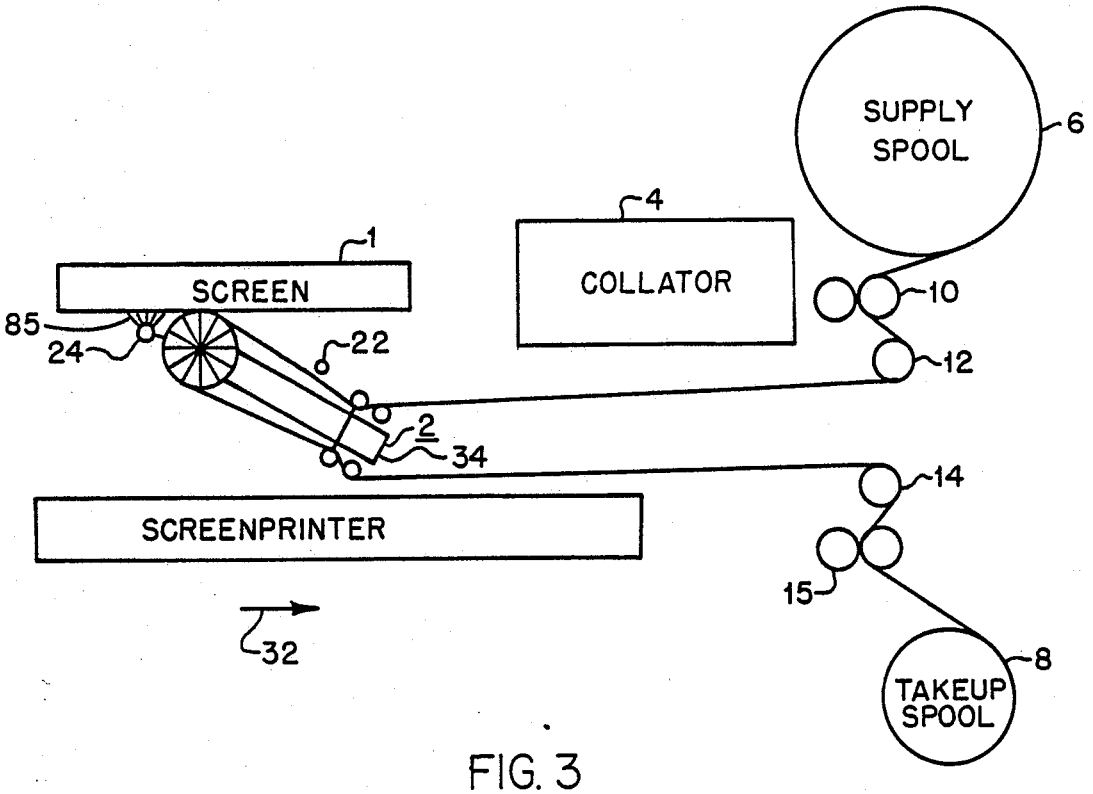

In FIG. 2, cleaning head carriage 2 advances in a first direction indicated by arrow 30 and is rotated upwardly as illustrated, to enable the web upon roller 7 to contact the lower portion of screen 1 to be cleaned. The mechanism for rotating the head to the position shown in FIG. 2 will be described below. As carriage 2 moves in the first direction, the web is also advanced so that fresh web material is applied to the screen, which web material has previously been sprayed with a liquid solvent emitted from an apertured tube 22, which causes the solvent to be ejected into the pores of the poly-foam web. Ejector 22 may be characterized as a spray bar for producing spray 20. The lower roller pair will pull the belt about roller 7 to enable the web to be advanced as the entire carriage 2 moves across the underside of the screen 1, until roller 7 is positioned at the left-hand portion of screen 1. As shown in FIG. 3, after this occurs, the head carriage 2 is moved in the opposite direction, indicated by arrow 32, and a drying gas such as nitrogen under pressure is directed at the lower portion of screen 1 by gas ejector 24 which comprises an elongated apertured tube. As head carriage 2 returns to the right-hand position illustrated in FIG. 2, the web will continue to be fed about wiper roller 7 in the counterclockwise direction to enable the web to pick up excessive solvent which may be present at the lower screen surface. The cycle is completed when carriage 2 is rotated to assume the horizontal position illustrated in FIG. 1, so that it is out of the way of unit 4.

Thus the web continues passing over the wiper roller 7 when the carriage moves from right to left in a first direction, while a liquid solvent is being injected into the porous web, until the lower surface of the screen is cleaned. The carriage thereafter reverses direction, a drying gas is applied to the lower surface of the screen while fresh belt portions are fed over the wiper roller to aid in removing excess solvent from the lower surface of screen 1. After completion of the cleaning cycle, printing again commences in the usual fashion until it is deemed desirable to again initiate the aforesaid process, to clean the screen once more.

Figure 4:
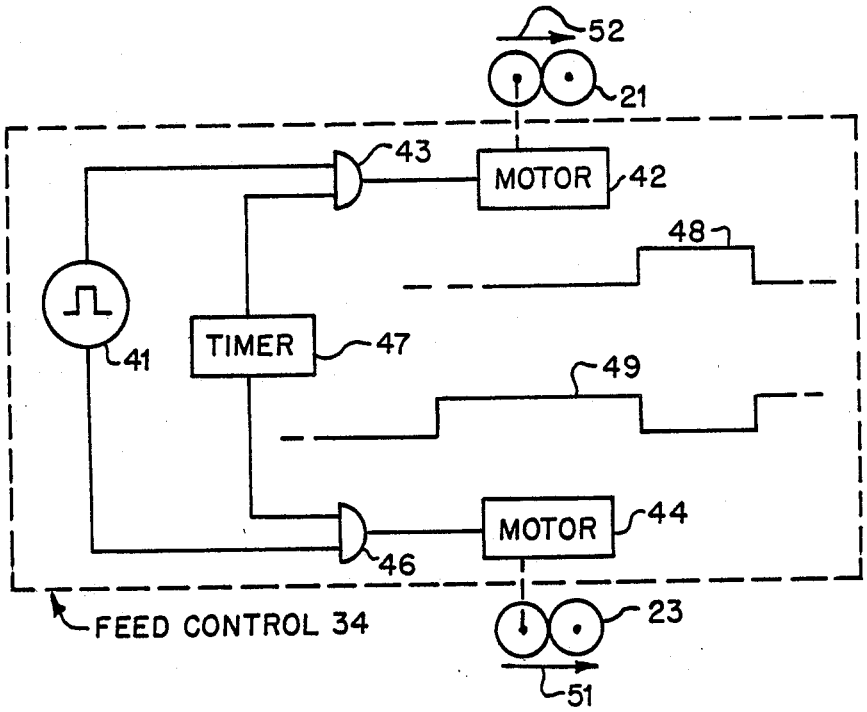
FIG. 4 illustrates the web feed control device.

The web is, on balance, fed in a counter-clockwise direction about wiper roller 7. However, it is greatly preferred to provide a web feed control means 34, which may be positioned upon carriage 2, to advance the web or belt about the wiper roller during a first time interval, and thereafter cause the web to be retracted or pulled back clockwise about wiper roller 7 during a second time interval, which is substantially shorter than the first interval. Since the second interval is preferably one-half of the first interval, it may be seen that on balance the web is moved counter-clockwise about wiper roller 7. This action improves the cleaning ability of the porous web. Stepping motor driven belt feed control circuit 34 of FIG. 4, is utilized to perform the "2N steps forward N and steps back" stepping of the porous belt about wiper roller 7. Motor 44, which could be a tiny conventional stepping motor, drives the lower roller pair 23 to cause the web to be driven forward in the direction of arrow 51, to be pulled counter-clockwise about wiper roller 7. Timer 47 produces pulse 49, which enables AND GATE 46 to cause 2N pulses produced by generator 41 to step motor 44, to pull the web forward (arrow 51) during a first-time interval equal to the width of pulse 49. At the trailing edge of pulse 49, timer 47 produces pulse 48 which enables AND GATE 43, to thereby cause a lesser number of pulses N to be applied to motor 42 to pull the web backwardly in the direction indicated by arrow 52. However, timer 47 produces enabling pulse 48 which preferably has for example ne-half of the width of pulse 49, so that it should now be appreciated that the web is pulled forward by 2N increments (e.g. 20) and thereafter pulled back by N increments (e.g. 10). After AND GATE 43 is disabled at the trailing edge of pulse 48, pulse 49 is again produced to re-enable AND GATE 46 to gain step motor 44 to pull the web forward again. This feed control unit 34 could be mounted upon carriage 2 or, if desired, could be utilized in connection with the other rollers discussed above. Thus retraction increments, proportional to the width of pulse 48, are interspersed with advancement increments, proportional to the width of pulse 49. Conventional stepping motors 42 and 44 preferably drive the web at an average velocity of between 0.5 and 6 inches per second. Thus, the benefits of a back-and-forth motion of the belt are attained while on balance the belt is drive forwardly to continually supply fresh belt material for the most efficient cleaning. This may be contrasted with prior art use of rollers for carrying porous material containing liquid solvent for cleaning xerographic drums, to remove excess toner from the drum.

Figure 6:
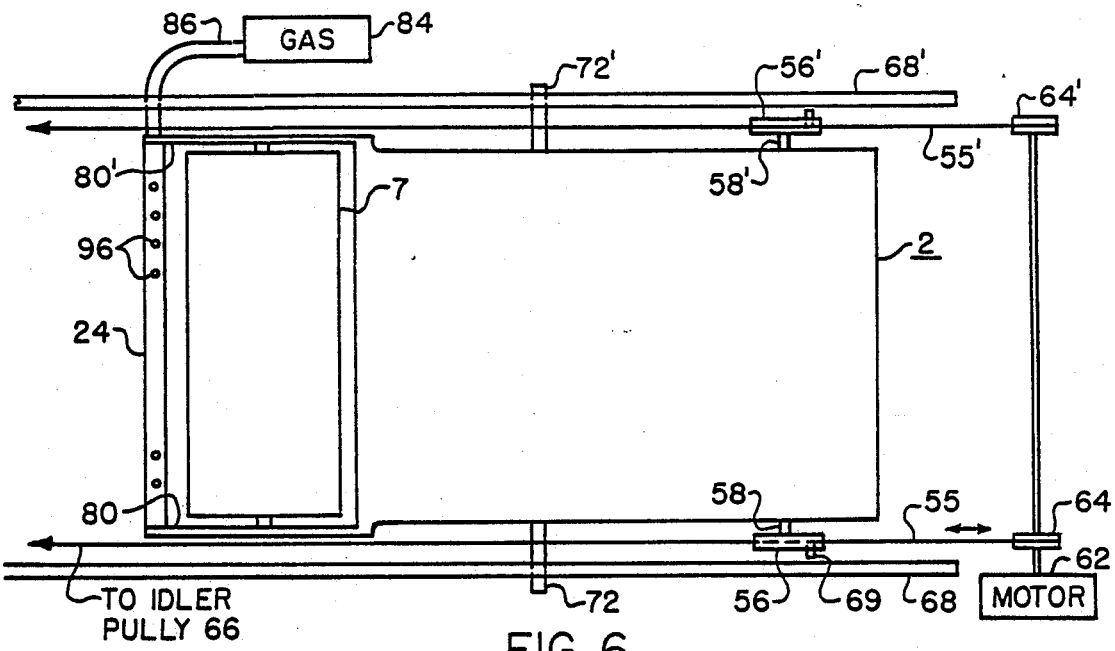
FIG. 5 and 6 illustrate the carriage position control device.
Figure 5:
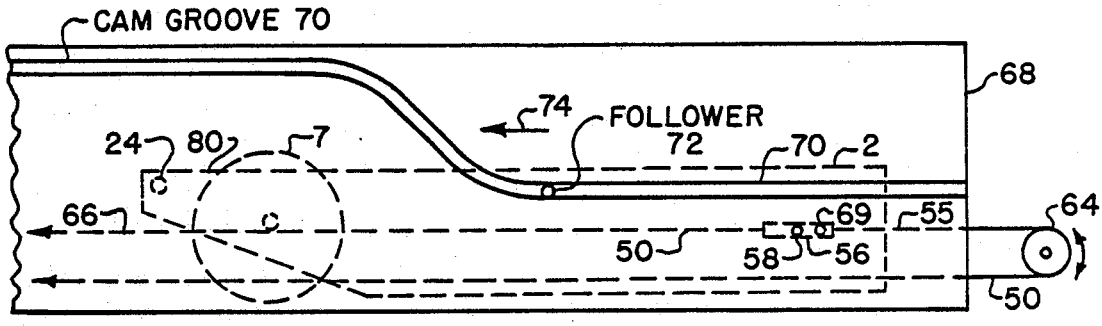

FIGS. 5 and 6 illustrate exemplary apparatus for driving head carriage 2 through the various positions discussed above. Carriage 2, together with wiper roller 7, and gas ejector 24, are illustrated in FIGS. 5 nd 6, together with a pair of drive cables 55 and 55'.

Cable 55 is shown coupled to a sleeve member 56 which is pivotably coupled to carriage 2 via stud 58. Cable 55 is passed about drive pulley 64 and an idler pulley (not shown). Drive motor 62 causes pulley 64 to rotate counter-clockwise to pull cable portion 50 to the left since the cable is wound about the idler pulley. Cam follower studs 72 and 72' are fitted within a pair of cam grooves 70 shown in FIG. 5 so that as carriage 2 is initially translated to the left, the action of cam groove 70 and follower 72 (and 72') causes carriage 2 to be rotated upwardly in a clockwise direction as explained previously. The top portion of the wiper roller 7 will thus be positioned at the proper distance away from the bottom of screen 1, since this distance is carefully controlled by the position of cam grooves 70 within side plates 68, and 68'; which may be adjusted vertically. Since the belt thickness is fixed, the best pressure against screen 1 is thus readily controlled.

The reversing of the direction of motor 62, causes the carriage to now be pulled to the right, and since follower 72 is coupled to the carriage, the action of the follower within the descending groove of the cam will produce counter-clockwise rotation of the carriage until it again assumes the horizontal position shown in FIG. 1.

Side plates 80 and 80', rotatably support wiper roller 7, along with gas ejector tube 24, which is laterally offset with respect to the wiper roller so that the roller does not interfere with the application of nitrogen to the screen during the drying cycle, as the carriage moves from left to right. Apertures 96 are formed within ejector tube 24, coupled to nitrogen tank 84 via a flexible tube 86, which supplies nitrogen gas at a pressure of between twenty and eighty PSI. The application of nitrogen to the lower screen portion is schematically illustrated at 85 in FIG. 3 whereas the application of solvent by spray bar (22) is schematically illustrated at 20 shown in FIG. 2. Cable 55 is securely bound to sleeve 56 by virtue of set screw 69. A number of the aforesaid components of FIG. 5 have their counterparts primed as shown at the upper portion of FIG. 6.

Clearly, many modifications and variations of the present invention are possible in light of the above teachings and it is therefore understood, that within the inventive scope of the inventive concept, the invention may be practiced otherwise than specifically claimed.

What is claimed is:

1. Apparatus for cleaning screens utilizing an elongated porous web comprising:

(a) a screen cleaning head carriage having wiper means mounted on a first portion thereof, a first web guide means mounted upon a second portion thereof, a second web guide means mounted upon a third portion thereof, a solvent ejector for directing solvent at said elongated porous web before said web passes over said wiper means during motion of said head carriage in a first direction, and a drying gas ejector for directing drying gas at said screen during motion of said head carriage in second direction opposite said first direction;

(b) supply means for supplying said web to said first guide means;

(c) takeup means for taking up said web from said second guide means;

(d) head carriage position control means for causing said head carriage to pass over said screen in said first direction while said web positioned over said wiper means contacts said screen, and for thereafter causing said head carriage to pass over said screen in said second direction while said web positioned over said wiper means contacts said screen; and (e) web feed control means for causing fresh, successive, wetted portions of said web to pass over said wiper means in contact with said screen during relative motion of said head carriage in a first direction and means responsive to movement of said head carriage in said second direction for causing fresh unwetted portions of said web to pass over said wiper means in contact with said screen during motion of said head carriage in said second direction to remove excess solvent from said screen.

2. The apparatus of claim 1 including a supply tank and said drying gas ejector comprises an elongated apertured tube coupled to said supply tank supply gas to said tube at a pressure of between 20 and 80 PSI.

3. Apparatus of claim 2 wherein said head carriage position control means includes cam means for rotating said cleaning head toward said screen during translation of said carriage in said first direction, and for also rotating said cleaning head away from said screen during translation of said screen in said second direction.

4. The apparatus of claim 1 wherein said porous web is made of plastic foam.

5. The apparatus of claim 1 wherein said wiper means comprises a freely rotatable roller rotatably mounted upon said cleaning head carriage.

6. Apparatus of claim 1 wherein said web feed control means includes means for advancing said web about said wiper means in advancement increments and retracting said web about said wiper means in retraction increments interspersed with said advancement increments, said retraction increments being substantially smaller than said advancement increments.

7. The apparatus of claim 6 wherein said web feed control means drives said web at an average velocity of between 0.5 and 6 inches per second.

8. The apparatus of claim 7 including stepping motor means wherein said first and second guide means each comprise a pair of drive rollers driven by said stepping motor means.

9. The apparatus of claim 6 including stepping motor means wherein said first and second guide means each comprise a pair of drive rollers driven by said stepping motor means.

10. Apparatus of claim 6 wherein said head carriage position control means includes cam means for rotating said cleaning head toward said screen during translation of said carriage in said first direction, and for also rotating said cleaning head away from said screen during translation of said screen in said second direction.

11. The apparatus of claim 6 including a supply tank and said drying gas ejector comprises an elongated apertured tube coupled to said supply tank supplying gas to said tube at a pressure of between 20 and 80 PSI.

12. The apparatus of claim 11 including means for mounting said tube upon said head carriage at a position whereby said tube is laterally offset with respect to said wiper means.

13. The apparatus of claim 6 wherein said porous web is made of plastic foam.

14. The apparatus of claim 13 wherein said wiper means comprises a freely rotatable roller rotatably mounted upon said cleaning head carriage.

15. Apparatus of claim 13 wherein said head carriage position control means includes cam means for rotating said cleaning head toward said screen during translation of said carriage in said first direction, and for also rotating said cleaning head away from said screen during translation of said screen in said second direction.

16. The apparatus of claim 6 wherein said retraction increments are about half of said advancement increments.

17. The apparatus of claim 16 wherein said porous web is made of plastic foam.

18. The apparatus of a claim 17 including a supply tank and said drying gas ejector comprises an elongated apertured tube coupled to said supply tank supplying gas to said tube at a pressure of between 20 and 80 PSI.

19. The apparatus of claim 18 including means for mounting said tube upon said head carriage at a position whereby said tube is laterally offset with respect to said wiper means.

20. The apparatus of claim 19 wherein said wiper means comprises a freely rotatable roller rotatably mounted upon said cleaning head carriage.

* * * * *